US005226665A

United States Patent [19]

Huang

[11] Patent Number: 5,226,665

[45] Date of Patent: Jul. 13, 1993

[54] ANTISTICK PVC PLAYING-CARDS

[75] Inventor: Kong-Ho Huang, Taichung, Taiwan

[73] Assignee: A Plus Playing Card Co., Ltd., Taichung, Taiwan

[21] Appl. No.: 871,509

[22] Filed: Apr. 21, 1992

[51] Int. Cl.[5] ..... A63F 1/02

[52] U.S. Cl. ..... 273/295; 273/293; 273/DIG. 5

[58] Field of Search ..... 273/295, DIG. 5, 293, 273/292, 149 P

[56] References Cited

U.S. PATENT DOCUMENTS

| | | | |
|---|---|---|---|
| 2,012,288 | 10/1930 | Roon | 273/295 |
| 2,341,884 | 2/1944 | Sowa | 273/295 |
| 3,068,010 | 12/1962 | Hagopian | 273/295 |
| 3,667,759 | 6/1972 | Barr | 273/293 |
| 4,119,322 | 10/1978 | Weigl | 273/293 |
| 5,067,713 | 11/1991 | Soules et al. | 273/149 P |

*Primary Examiner*—Benjamin H. Layno
*Attorney, Agent, or Firm*—Bacon & Thomas

[57] ABSTRACT

An antistick playing-card made from a sheet of polyvinyl chloride coated with a paint and embossed with stripes and raised portions on two opposite surfaces thereof by means of the operation of an embossed impression cylinder and through the radiation of an ultraviolet device.

1 Claim, 2 Drawing Sheets

ANTISTICK PVC PLAYING-CARDS

BACKGROUND OF THE INVENTION

The present invention relates to playing-cards, and more particularly, the present invention relates to playing-cards made from polyvinyl chloride sheets and used in playing games which will not stick and can be smoothly shuffled.

Playing-cards are widely accepted by people of all ages for playing a variety of games for the advantages of being easy to learn and play. In early days, playing-cards were simply made of paper. In recent years, polyvinyl chloride (PVC) has been commonly used in making playing-cards. However, PVC playing-cards may stick together easily due to the effect of atmosphere pressure or contamination by sweat. Therefore, it is not easy to shuffle a pack of PVC playing-cards.

SUMMARY OF THE INVENTION

The present invention has been accomplished to eliminate the aforesaid problems. It is therefore the main object of the present invention to provide playing-cards which do not stick and, which are durable in use.

DETAILED DESCRIPTION OF THE PREFERRED EMBODIMENT

Figure 1:
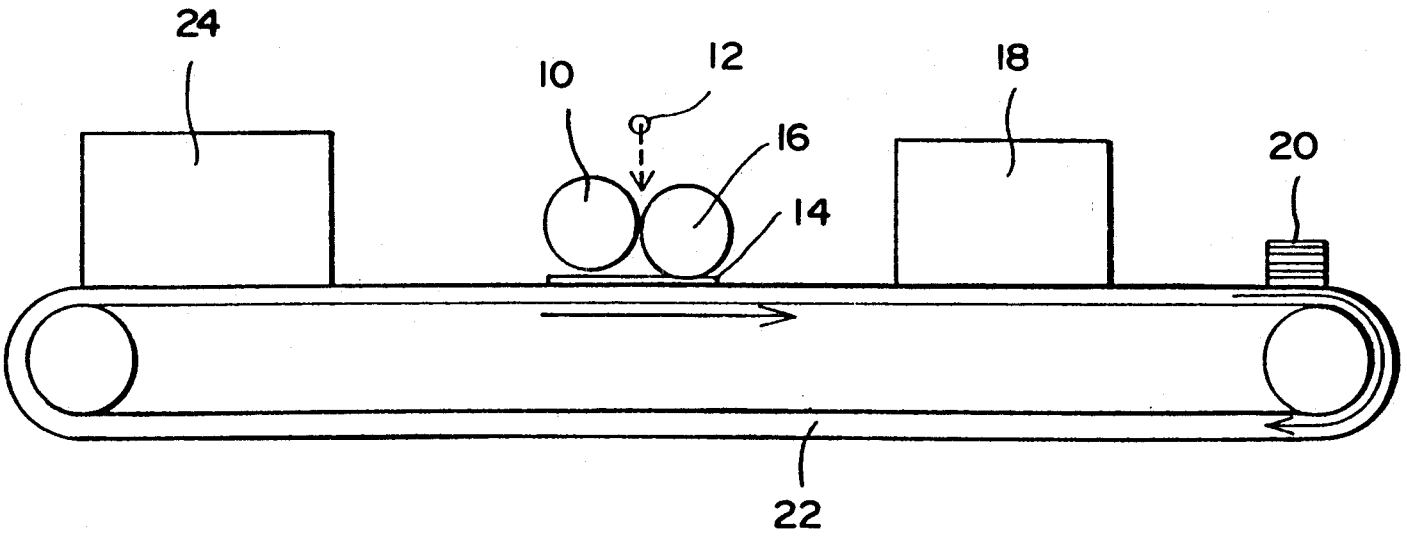
FIG. 1 is a flow chart showing the process in making antistick playing-cards according to the present invention.

Referring to FIG. 1, therein illustrated is a flow chart showing the process in making antistick playing-cards according to the present invention, in which the numeral "24" designates a material feeder; the numeral "10" designates an embossed impression cylinder; the numeral "12" designates a painting duck; the numeral "16" designates a printing cylinder; the numeral "14" designates a card body; the numeral "18" designates an ultraviolet device; the numeral "22" designates a conveying belt; and the numeral "20" designates a finished playing-card. In the aforesaid fabrication process, both the concentration of the paint to be used in coating card bodies embossed by impression cylinder 10 and the length of time required in exposing printed card bodies to the ultraviolet device 18 can be adjusted according to actual requirements. The ultraviolet device 18 is used to harden the paint in a short period of time and prevent same from spreading, thus resulting in a surface having raised stripes and raised portions. The paint may be an ultraviolet curable varnish, such as formed from an acrylate monomer base. The pattern on the impression cylinder 10 can also be changed as desired.

Figure 2:
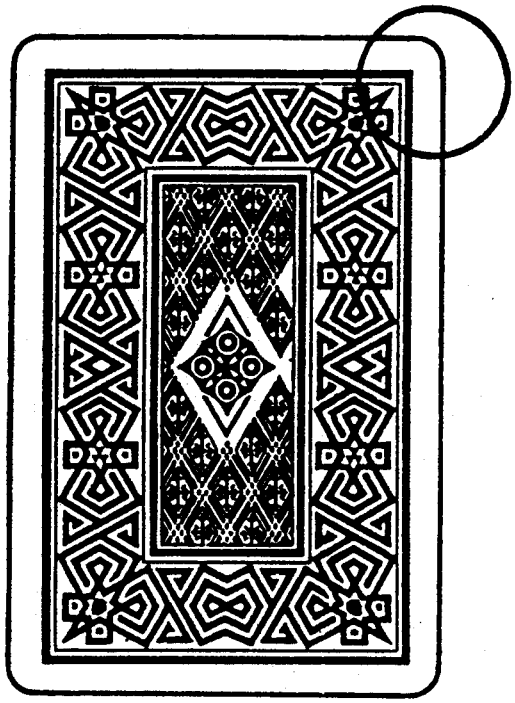
FIG. 2 is a front view of a finished playing-card made according to the present invention.
Figure 2A:
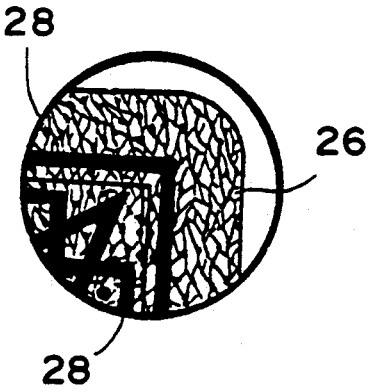
FIG. 2A is a partly enlarged view of a corner of a finished playing-card.

Referring to FIG. 2, therein illustrated is a playing-card made through the aforesaid process. As illustrated, the antistick playing-card has raised stripes 26 and raised portions 28 on the top surface thereof. The arrangement of the raised stripes 26 and the raised portions 28 is also provided on the opposite surface and prevents one playing-card from sticking to another because air gaps are formed and maintained between adjacent cards by stripes 26 and portions 28.

As indicated, the present invention is to provide antistick playing-cards which do not stick easily and can be shuffled smoothly.

What is claimed is:

1. An antistick playing card comprising a sheet of polyvinylchloride provided with an ultraviolet hardened paint coating defined by raised stripes and raised portions on opposite sides of the card to form and maintain air gaps between two adjacent cards and prevent the cards from sticking together.

* * * * *